United States Patent [19]

Blanton

[11] Patent Number: 4,986,727

[45] Date of Patent: Jan. 22, 1991

[54] PRESSURE-OPERATED OIL AND GAS WELL SWABBING DEVICE

[75] Inventor: James R. Blanton, Carrollton, Tex.

[73] Assignee: Petro-Well Supply, Inc., Dallas, Tex.

[21] Appl. No.: 221,891

[22] Filed: Jul. 20, 1988

[51] Int. Cl.[5] ..... F04B 47/12

[52] U.S. Cl. ..... 417/57; 417/58; 417/60; 417/555.2

[58] Field of Search ..... 417/56, 57, 58, 60, 417/555 A

[56] References Cited

U.S. PATENT DOCUMENTS

| | | | |
|---|---|---|---|
| 862,867 | 8/1907 | Eggleston | 417/390 |
| 2,555,112 | 5/1951 | Brown | 417/57 X |
| 4,070,134 | 1/1978 | Gramling | 417/56 |
| 4,712,981 | 12/1987 | Gramling | 417/56 |

FOREIGN PATENT DOCUMENTS

| | | | |
|---|---|---|---|
| 523801 | 5/1956 | Canada | 417/56 |

*Primary Examiner*—Carlton R. Croyle
*Assistant Examiner*—D. Scheuermann
*Attorney, Agent, or Firm*—Sigalos, Levine & Montgomery

[57] ABSTRACT

An oil well swabbing device having a pressure activated valve for use in closing a fluid passage therein when the swabbing device is submerged under liquid in a well casing corresponding to a predetermined valve closing pressure; the pressure-activated valve comprising a pressure collapsible bladder such as a bellows or diaphragm, a valve and seat interposed in the fluid passage, and an actuator rod connecting the valve to the pressure collapsible bladder such that the valve is closed when the bladder is collapsed to a degree corresponding to the predetermined valve closing pressure. Improved speed brakes, catchers, and position indicators for oil well swabbing devices are also disclosed.

11 Claims, 3 Drawing Sheets

PRESSURE-OPERATED OIL AND GAS WELL SWABBING DEVICE

BACKGROUND OF THE INVENTION

1. Field of the Invention

The present invention relates to the field of gas and oil well swabs and particularly to oil swabs which are self-actuated and use the well gas pressure to repeatedly remove quantities of accumulated liquid from the well casing.

2. Description of the Prior Art

Gas and oil well swabs having slidable cup seals and an internal passage with a valve being closed solely by the movement of a piston sliding inside a cylinder have been described in U.S. Pat. No. 4,070,134. The prior art device comprises a cylinder having a piston inserted into an open end thereof, which piston is connected through a actuator rod to the valve. The cylinder is provided with an initial charge and the piston is provided with sliding seals. The oil swab is intended to sink below a predetermined level of liquid in the casing. This causes an increase in pressure, which increase in pressure compresses the piston against the charge in the cylinder causing the valve to move against the seat. It has been found that under ideal conditions such an arrangement will function as described. However, under the existing varied operating conditions, such a device often either operates only erratically or fails altogether and remains submerged in the well.

An attempt to resolve the foregoing problems is set forth in U.S. Pat. No. 4,712,981. In that patent, the problem was identified as one in which the valve ball does not seat because a nearly seated condition causes a restriction and a pressure build-up sufficient to stop the descent of the tool but insufficient to raise the swab. Alternatively, the problem is identified as resulting from an inordinate amount of pressure being placed upon the valve, thereby jamming it against the seat and "rendering it useless." The solutions disclosed have not successfully eliminated the inconsistent operation and failure of the prior art swabbing devices.

The foregoing swabs also employ a speed brake device consisting of a free-floating steel ball which is moved, by rushing gas, upward into a restrictive opening. The turbulence of the rushing gas causes the ball to bounce violently and damage itself and damages the opening of the restrictive passageway into which it eventually moves.

In the prior art, a catching mechanism is also used to hold the swab at the top of the oil well casing, which mechanism employs a sharp nosed plunger which becomes rapidly worn due to repeated use. Such undue wear can make the catching mechanism ineffective.

It has been difficult with prior art automatic swabbing devices to determine when the swabbing device was at the top of the well and, therefore, in a position for being caught. It is important to determine when the swabbing device reaches the top of the well without removing the well head. Built-up pressure must be relieved before removing the automatic swab from the well casing.

SUMMARY OF THE INVENTION

The present invention properly identifies one of the problems associated with obtaining continuous operation of self-actuated swabbing devices as being related to the inability of the prior art piston to maintain a proper seal while sliding in the cylinder. The nature of such a cylinder and piston pressure actuating device is such that the pressure in the cylinder becomes equalized with the pressure outside of the cylinder. Thus, there is no pressure differential to force the seals outward against the cylinder. The seal must be maintained entirely by mechanical resilence of the seal material. The environment of the well, including both corrosive and abrasive elements cause wear on the seal, thereby reducing its mechanical resilience and its effectiveness. Once the seal between the piston and the cylinder deteriorates, the pressure is equalized across the seal without moving the piston, thus the valve ceases to be actuated. The oil swab remains in the well indefinitely or until it is mechanically retrieved.

To overcome the foregoing identified problem, this invention removes the need for a sliding seal by providing a pressure compressible bladder. The bladder compression is transduced into linear motion of the valve to properly and consistently close the valve. By using a continuous compressible bladder, such as a flexible diaphragm or a bellows arrangement, the problem with sliding piston sealing is eliminated and the swabbing device operates consistently.

The invention also comprises a novel speed brake, catcher, and indicator as set forth below.

DETAILED DESCRIPTION OF THE DRAWINGS

Figure 1:
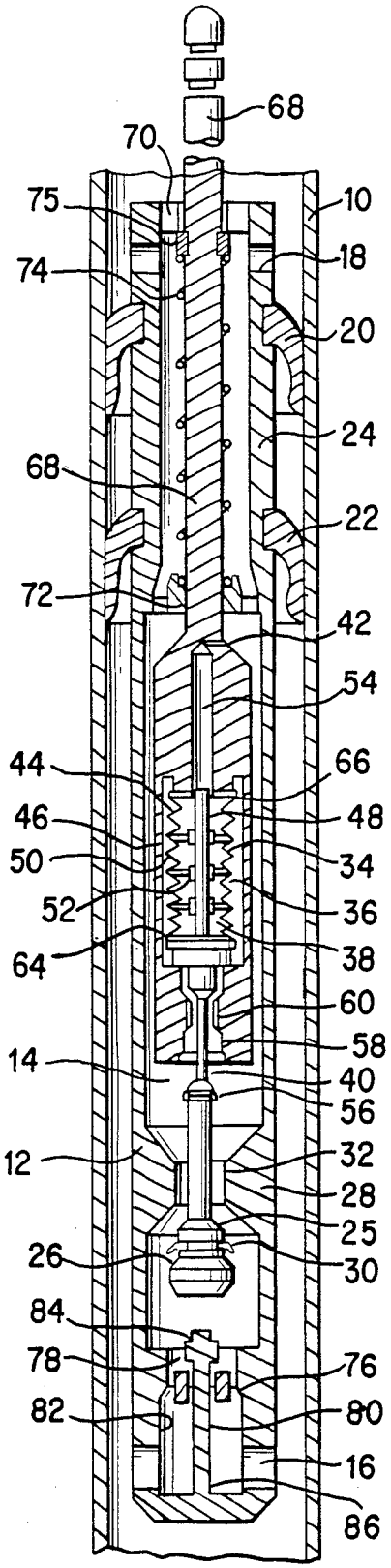
FIG. 1 is a partial cross-sectional view of an improved swabbing device shown in position within a portion of a well casing.
Figure 2:
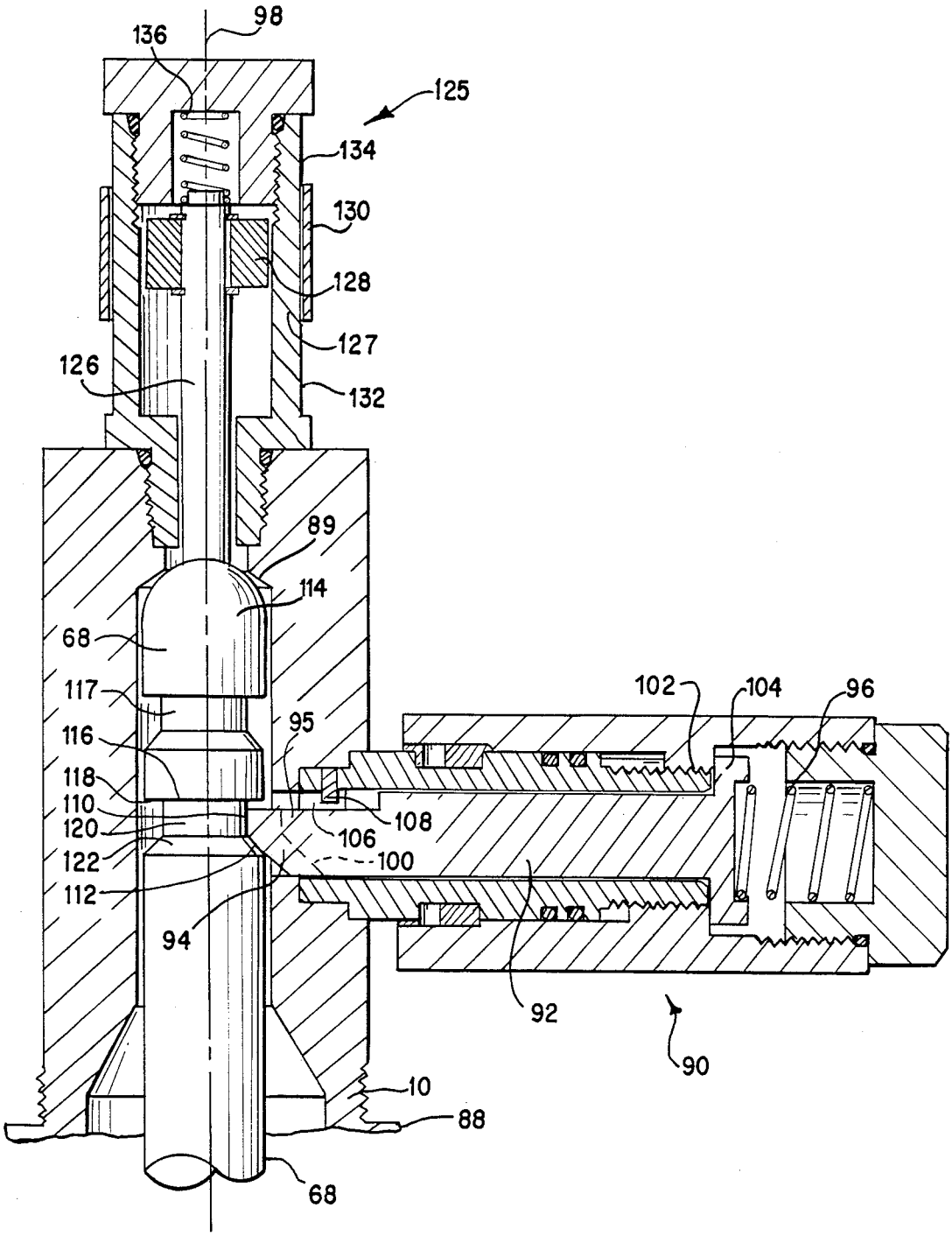
FIG. 2 is a partial cross-sectional view of the oil swab catcher and catcher indicator for an improved well swabbing system.

With reference to FIG. 1, a typical well casing 10 is shown with an oil well swabbing device positioned for operation within the casing. The swabbing device body 12 defines an interior fluid passage 14. Gas or liquid enters the lower fluid entry orifice 16, passes vertically upward through fluid passage 14, and out through upper fluid exit orifice 18. The fluid thereby bypasses upper seal cup 20 and lower seal cup 22, which are sealingly fastened about swabbing body 12. Cup seals 20 and 22 slide against the inside of well casing 10. There is a cup spacer means 24 provided to separate the upper and lower seal cups 20 and 22 so that at least one of said seal cups is in contact with a smooth portion of the well casing even as the device passes by joints or coupling sections of the casing.

Disposed within fluid passage 14 is a valve assembly 25 comprising a main valve surface 26 and a main valve seat 28. Sealing is accomplished when main valve 26 engages main valve seat 28; however, it has been found to be advantageous to provide valve assembly 25 with resilient seal 30 which engages a smooth valve seal surface 32.

The valve assembly 25 is actuated upon compression of a pressure compressible bladder means 34. The well pressure is communicated to well pressure chamber 36 surrounding the bladder. Compression of the bladder as the well pressure increases acts to equalize the well pressure with the pressure within bladder charge chamber 38. The bladder is connected through a valve actuator rod 40 to the valve 25 which upon compression moves upward, thereby moving main valve surface 26 against main valve seat 28. The initial charge placed in the bladder chamber 38 through a bladder charging tube 42 prior to assembly of the device. The charging tube 42 is sealed, which sealing may advantageously be provided using a spring loaded valve and seat such as those found in a standard tire valve stem. The charge pressure can then be easily adusted or readjusted during maintenance to achieve different activation depths.

It has been found that the bladder can be advantageously constructed as a bellows arranged in an accordion fashion. Such a bellows can be advantageously constructed by forming and welding thin sheets of stainless steel. To effectively transduce the compression of the bladder or bellows into axial translation of the valve actuator rod 40, an internal bladder rod 48 is rigidly affixed in axial alignment with the actuator rod 40 and is guided by internal rod guides 50 positioned along the length of the bladder or bellows. In the case of a welded stainless steel bellows these rod guides are also stainless steel and are welded to the inside of the bellows. Each of the internal rod guides 50 support rod guide bushings 52 which may advantageously be constructed from teflon or similar wear-resistant bushing material. There is a bladder rod expansion chamber 54 into which bladder rod 48 extends and is further guided when compression of the bladder or bellows takes place. Once the valve assembly 25 closes the fluid passage 14, the pressure within the well pressure chamber 36 will theoretically be maintained at the head pressure corresponding to the volume of liquid above the swabbing device plus the well head gas pressure. However, in the event that the contact between valve 26 and seat 28 fail to stop the translation of actuator rod 40, a bladder protection seal 56 is positioned along the valve actuator rod 40 so that it enters and forms a seal with bladder protection seal surface 58 after a predetermine amount of additional actuator translation. This prevents excessive and potentially destructive pressure from building up on the bellows.

It will be understood that in the embodiment in which a stainless steel bellows is employed, such bellows is continuously welded at 64 to the actuator rod 40 and at 66 to the external bladder housing 46. As the bellows surface is continuous and there are no sliding surfaces to be sealed, there is no leakage and no equalization of pressure without compression of the bellows and associated actuation of the valve to a closed position. The swabbing device works consistently and repeatedly raises the same volume of liquid each time it rises in a particular well.

To unseat the main valve, extension shaft 68, which is attached to the bladder housing 46, is mechanically depressed so that it slides downward through upper extension shaft guide 70 and lower extension shaft guide 72, thereby compressing compression spring 74 and pushing the actuator rod 40 through the bellows or bladder 34. The valve assembly is normally opened only after the liquid has been removed from above the swabbing device. The pressure in the oil pressure chamber is reduced because there is no liquid head pressure. The bellows 34 expands to substantially equalize the pressure so that the valve remains open as extension shaft 68 moves back to its normal position relieving the tension on compression spring 74.

The expansion and compression of a bladder generally or a bellows particularly is governed according to the formula:

$$\frac{P1\ V1}{T1} \approx \frac{P2\ V2}{T2}.$$

Of course, depending upon the spring and dampening characteristics of the bladder or bellows material, this equation is only an approximation. Nevertheless, as the springing and dampening characteristics of the bellows can be assumed to be substantially constant for any particular bladder or bellows arrangement, the depth to which the swabbing device will sink (or the volume of oil which it will carry) should remain substantially constant for a given operating temperature and pressure of a particular well.

When the swabbing device is dropped into a casing having only gas therein, the gas passes readily through the fluid passage 14, there is no substantial pressure differential below and above the seal cups 20 and 22 so that the device accelerates down the shaft, slowed only by the natural friction between the casing and the seal cups. In order to produce a pressure differential to slow the descent, a speed brake is employed which reduces the area through a portion of fluid passage 14.

To advantageously reduce wear on the speed brake, a brake guide means 80 is vertically disposed substantially coaxially with a narrow passage portion 78 and a wide cylindrical passage portion 82 which is adjacent and below the narrow passage. Restriction means 76 slides on guide means 80 between a narrow passage portion 78 and a wide passage portion 82. There is an upper stop 84 and a lower stop 86 which keeps the restriction means 76 slidably in place on the guide rod 80. As the swab falls freely, restriction means 76 becomes relatively weightless and the gas flowing through fluid entry orifice 16 pushes the restriction means upward against stop 84, thereby further narrowing narrow passage portion 78. The volume restriction is calculated to provide a differential pressure across the restriction and, therefore, across seal cups 22 and 20 such that the pressure differential multiplied by the cross-sectional area of the casing provides sufficient force to counteract the acceleration of gravity, thereby slowing the descent to a constant velocity.

In the preferred embodiment the narrow passage portion is cylindrical and the restriction means is correspondingly cylindrical for ease of construction, calculation of area, and because no rotational orientation means is required.

When an adequate volume of liquid has formed above the oil swabbing device, the oil swabbing device will rise to the top and discharge the liquid through a discharge means 88 which may, for example, be a standard T connection at the upper end of the casing. A pipeline can be connected to a separator (not shown) at which the liquid is separated from gas. An internal stop surface 89 is provided at the upper end of casing 10 for abutting against the top portion 114 of extension shaft 68. Mechanically stopping the upward motion of the extension shaft 68 while the oil swab body continues to rise due to the pressure underneath it, effectively pushes valve 25 open thereby releasing the pressure.

Applicant has discovered in testing that in some installations the combination of pressure conditions within the well and within the pipeline can result in an undesirable rapid opening and closing of the valve 25 when the gas pressure is released from the well to the pipeline. As long as there is a difference between the pressure above the tool (line pressure) and below the tool (well pressure) which is sufficient to support the weight of the oil swabbing device body, the valve 25 will be pushed open and the gas pressure will discharge. However, when the pressure above increases due to a high volume of gas flow which is not quickly evacuated through the line, the pressure above can become nearly equal to the high pressure below, the weight of the device body 12 is no longer supported and it starts moving back down into the well. Since the valve seat 28 moves with the device body 12 and the extension shaft 68, to which valve 26 is attached, remains stationary against stop surface 89, the valve seat 28 moves downward against valve 26. This closes the flow of high pressure gas. The pressure above drops to line pressure and the device body 12 again raises rapidly, unseating and opening the valve 25. The pressure above becomes high again and the cycle is repeated, sometimes in a rapid chattering manner.

Figure 3:
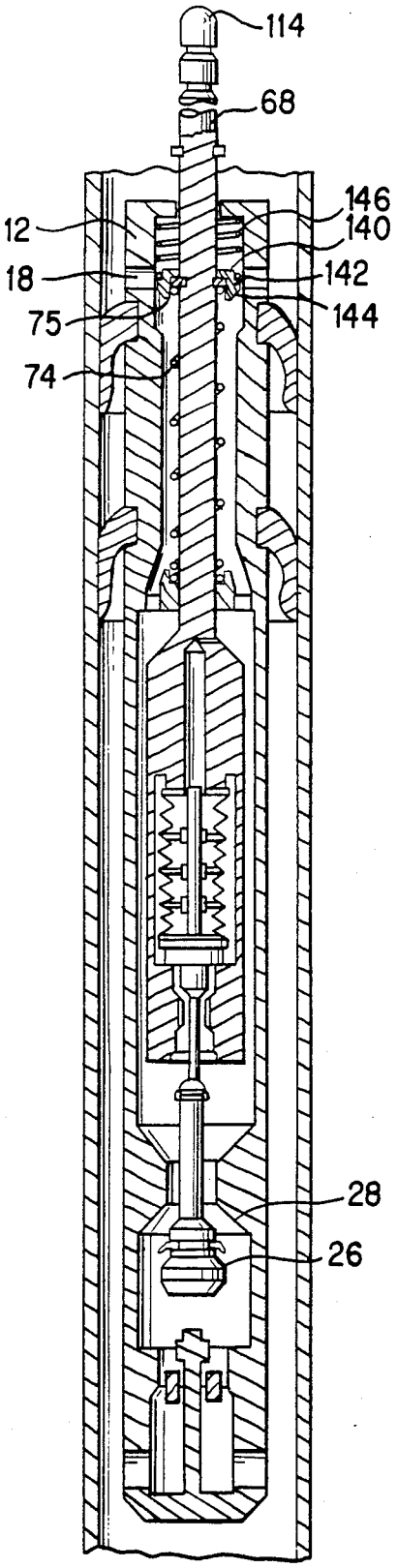

To alleviate this situation, Applicant has devised an embodiment shown in FIG. 3, in which a discharge restriction means 140 is inserted below upper extension guide 70 and above compression spring 74 and stop 75. This restriction means 140 has a cylindrical restriction 142 sized to restrict flow around it when it is below openings 18. Also, it opens gradually due to a tapered nose portion 144 as it is raised upwardly past openings 18. A spring 146 acts to keep the cylindrical restriction 142 below the side openings 18 until the restriction and flow volume are sufficient to overcome the spring tension and push the restriction to an open position. Thus the restriction and spring act as a relief valve to maintain a sufficient differential pressure to keep valve body 12 up in relation to valve 26 until the pressure below the device is at or near the line pressure. Thus, the reduction in the area of the upper passage slows the discharge of low pressure gas and acts to reduce the tendency to rapidly open and close during pressure discharge, yet high pressure gas opens the restriction fully and discharges normally. Rapid pressure equalizations above and below the swabbing device are reduced thereby reducing the chattering which can result from such rapid pressure equalizations.

It is often desirable to prevent the oil swabbing device from returning and descending into the oil well. In such a case, an oil well swabbing device catcher 90 comprising a plunger means 92 having a catching position 94 at which the plunger 92 is biased inwardly toward but not beyond the center 98 of casing 10. The inward bias can, for example, be provided by spring 96. The plunger has a releasing position 100 at which the plunger 92 is selectably held outwardly against the inward bias provided by spring 96. This may be accomplished by manually threading collar 102 outward against plunged ledge 104.

Advantageously, a blunted nose portion 95 is formed on plunger 92. The blunted nose portion comprises an upwardly disposed flat portion 106 which acts to prevent the pin from rotating using location pin 108. The blunted nose portion further comprises a vertically disposed flat portion 110 and a downwardly disposed beveled portion 112. The extension shaft 68 acts as the catching shaft attached to the top of the oil well swabbing device. The shaft 68 defines a rounded top 114 and at least one annular recess 116 adjacent to the rounded top. The annular recess 116 comprises a downwardly disposed flat surface 118, a vertically disposed cylindrical surface 120, and an upwardly disposed conical surface 122. The annular ring 116 corresponds in cross-sectional shape to the shape of plunger nose 95 such that in the catching position 94 and as the shaft 68 moves upward the plunger nose 95 rides outward on the rounded shaft top 114. The plunger pushes outwardly against bias 96 until the annular recess 116 is adjacent to plunger nose 95, at which point the plunger slips inwardly into annular recess 116. The oil swab is prevented from moving downward by contact between the corresponding flat surfaces 118 and 106.

In the preferred embodiment, there are two annular recess, 116 and 117, corresponding in shape to the shape of the plunger nose such that the oil swabbing device can be caught by either annular ring. However, in the normal situation stop surface 89 is adjusted so that the lowest annular ring 116 is adjacent to the plunger nose. Thus, in the event annular recess 116 is clogged or surface 118 is rounded or worn annular recess 117 acts as a safety catch. Applicant has found that this blunt nose portion uniquely reduces the wear of the plunger nose.

So that an operator can determine when the plunger is at the top of the well, an indicator device 125 is attached at the end of casing 110. The indicator device comprises an indicator plunger 126 having attached thereto a cylindrical magnet 128. Exterior to the body portion 129 is a free-floating ring having magnet responsive properties such as iron or steel. When the indicator shaft 126 is raised by extension shaft 68 of the oil swabbing device, the magnet 128 is correspondingly moved upwardly against spring 136. Through magnetic coupling the sleeve 130 is moved upward. At the exterior surface of body 127 there is a lower surface 132 and an upper surface 134. When the sleeve 130 covers the lower suface 132 it is an indication that the oil swab is still a distance down in the well and when the sleeve is covering surface 134, it is an indiction that the oil swab is at the top of the well. Surface 132, 134 and sleeve 130 can be colored with contrasting colors so that visual inspection conveniently indicates whether the oil swabbing device is at the top and whether the plunger is holding it there or whether the device has slipped back into the well.

While the invention has been described in connection with a preferred embodiment, it is not intended to limit the scope of the invention to the particular form set forth, but on the contrary, it is intended to cover such alternatives, modifications, and equivalents as may be included within the spirit and scope of the invention as defined in the claims.

What is claimed is:

1. In an oil well swabbing device, the improvement comprising a pressure activated valve for use in closing a fluid passage extending through the oil swabbing device from the top to the bottom thereof when said swabbing device is submerged under liquid in a well casing corresponding to a predetermined valve closing pressure; said pressure activated valve comprising:

(a) pressure collapsible bladder means;

(b) a valve and seat interposed in said fluid passage; and (c) means connecting said valve and seat means to said pressure collapsible bladder means such that said valve and seat are closed when said bladder is collapsed to a degree corresponding to said predetermined valve closing pressure.

2. The pressure activated valve of claim 1, wherein said bladder means further comprises a sealed bellows.

3. The oil well swabbing device of claim 1, further comprising a speed brake for use in restricting free flow of fluid through a vertically disposed passage in the oil well swabbing device when said swabbing device is "free falling" down a gas filled portion of the well casing so that a differential pressure caused by said restriction slows the rate of descent of said swabbing device, said speed brake comprising:

(a) a narrow passage portion;

(b) a wide passage portion coaxially adjacent and below said narrow passage portion;

(c) guide coaxial with and extending at least partially along the length of said wide and narrow passage portions;

(d) restrictions means slidably guided along said guide means between said narrow and wide passage positions, said restriction means correspondingly sized with said narrow passage portion to create a resctrictive area sufficiently small to slow the descent of said oil well swabbing device when it is free falling in a gas filled portion of said well casing and the flow of gas through said vertically disposed passage pushes said restriction means to said narrow passage portion; and (e) stop means associated with said guide means preventing said restriction means from sliding above said narrow passage portion and below said wide passage portion.

4. The oil well swabbing device of claim 1, further comprising a catcher for selectively catching or releasing an oil well swabbing device when said oil well swabbing device is at the top of the oil well casing, said catcher comprising:

(a) plunger means attached to an upper portion of said casing and having a catching position at which said plunger is biased inwardly toward but not beyond the center of said casing and a releasing position at which said plunger is held outwardly against said inward bias, (b) a blunted nose portion formed on said plunger comprising an upwardly disposed flat portion, a vertically disposed flat portion and a downwardly disposed beveled portion; and (c) a catching shaft attached to the top of an oil well swabbing device, which shaft defines a rounded top and at least one annular recess adjacent said rounded top comprising a downwardly disposed flat surface, a vertically disposed cylindrical surface and an upwardly disposed conical surface corresponding in cross section to the shape of said plunger nose such that, in the catching position and as said shaft moves upward, said plunger nose rides outward on said rounded shaft top against said bias and slips inward again when said annular recess is adjacent said plunger nose and said oil swab is prevented from moving downward by contact between the corresponding flat surfaces of said plunger nose and said annular recess of said shaft.

5. The oil well swabbing device of claim 1, further comprising an indicator for indicating whether the oil swabbing device is at the top of the well or down a distance from the top of the well, said indicator comprising:

(a) a downwardly biased indicator rod guided for coaxial contact with an extension rod, (b) a magnet fastened to said indicator rod for movement therewith, and (c) a sliding indicator sleeve exterior to the sealed indicator chamber, which sliding sleeve moves through magnetic coupling with the magnet fastened to the indicator rod.

6. The oil swabbing device of claim 1, further comprising a discharge restriction means for reducing rapid opening and closing of said pressure activated valve while gas pressure is relieved, said discharge restriction means comprising:

(a) a side discharge orifice defined by an upper portion of said fluid passage;

(b) cylindrical restriction positioned in the upper portion of said fluid passage above said pressure activated valve and bladder means, which cylindrical restriction is sized to slide within said passage and to restrict high pressure gas flow therearound; and (c) a spring means for placing downward tension on said cylindrical restriction to hold said cylindrical restriction below said side orifice during low pressure conditions and to permit said restriction to move upward to open said side orifice at high pressure conditions.

7. The oil swabbing device of claim 1 in which the bladder means further comprises:

(a) an internal axially aligned bladder rod; and (b) internal rod guides positioned along the length of the bladder so that compression of said bladder is effectively transduced into axial translation of said valve relative to said seat thereby closing said valve and seat when said bladder is axially compressed to a degree corresponding to said predetermined valve closing pressure.

8. In an oil well swabbing device, the improvement comprising a speed brake for use in restricting free flow of fluid through a vertically disposed passage in the oil well swabbing device when said swabbing device is "free falling" down a gas filled portion of the well casing so that a differential pressure caused by said restriction slows the rate of descent of said swabbing device, the speed brake comprising:

(a) a narrow passage portion;

(b) a wide passage portion coaxially adjacent and below said narrow passage portion;

(c) guide means coaxial with and extending at least partially along the length of said wide and narrow passage portions;

(d) restriction means slidably guided along said guide means between said narrow passsage portion to create a restrictive area sufficiently small to slow the descent of said oil well swabbing device when it is free falling in a gas filled portion of said well casing and the flow of gas through said vertically disposed passage pushes said restriction means to said narrow passage portion; and (e) stop means associated with said guide means for preventing said restriction means from sliding above said narrow passage portion and below said wide passage portion.

9. In an oil well swabbing device, the improvement comprising a catcher for selectively catching or releasing an oil well swabbing device when said oil well swabbing device is at the top of the oil well casing, said catcher comprising:

(a) plunger means attached to an upper portion of said casing and having a catching position at which said plunger is biased inwardly toward but not beyond the center of said casing and a releasing position at which said plunger is held outwardly against said inward bias, (b) a blunted nose portion formed on said plunger comprising an upwardly disposed flat portion, a vertically disposed flat portion and downwardly disposed beveled portion; and (c) a chatching shaft attached to the top of an oil well swabbing device, which shaft defines a rounded top and at least one annular recess adjacent said rounded top comprising a downwardly disposed flat surface, a vertically disposed cylindrical surface and an upwardly disposed conical surface corresponding in cross section to the shape of said plunger nose such that, in the catching position and as said shaft moves upward, said plunger nose rides outward on said rounded shaft top against said bias and slips inward again when said annular recess is adjacent said plunger nose and said oil swab is prevented from moving downward by contact between the corresponding flat surfaces of said plunger nose and said annular recess of said shaft.

10. In an oil well swabbing device, the improvement comprising an indicator for indicating whether the oil swabbing device is at the top of the well or down a distance from the top of the well, said indicator comprising:

(a) a downwardly biased indicator rod guide for coaxial contact with an extension rod, (b) a magnet fastened to said indicator rod for movement therewith, and (c) a sliding indicator sleeve exterior to the sealed indicator chamber, which sliding sleeve moves through magnetic coupling with the magnet fastened to the indicator rod.

11. In an oil well swabbing device of the type having a passage therethrough, sealing means therearound, a pressure activated valve in said passage, and means for mechanically opening said pressure activated valve to relieve gas pressure thereunder; a discharge restriction means for reducing rapid opening aand closing of said pressure activated valve while high pressure gas is relieved, said discharge restriction means comprising;

(a) a side discharge orifice defined by an upper portion of said fluid passage;

(b) cylindrical restriction positioned in the upper portion of said fluid passage above said pressure activated valve, which cylindrical restrictions is sized to slide within said passage and to restrict high pressure gas flow therearound;

(c) a spring means for placing downward tension on said cylindrical restriction to hold said cylindrical restriction below said side orifice during low differential pressure conditions and to permit said restriction to move upward to open said side orifice at high differential pressure conditions.

* * * * *